US006845762B2

(12) United States Patent
Modien

(10) Patent No.: US 6,845,762 B2
(45) Date of Patent: Jan. 25, 2005

(54) FORCE EMISSION CONTROL VALVE

(75) Inventor: Russell Modien, Chatham (CA)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 09/992,230

(22) Filed: Nov. 14, 2001

(65) Prior Publication Data

US 2003/0089349 A1 May 15, 2003

(51) Int. Cl.[7] ..... F02M 25/07

(52) U.S. Cl. ..... 123/568.21; 335/219; 335/255; 335/261; 251/129.15

(58) Field of Search ..... 123/568.21, 568.26, 123/568.27, 568.28; 251/129.09, 129.1, 129.15; 335/219, 220, 255, 256, 261, 262

(56) References Cited

U.S. PATENT DOCUMENTS

| | | | | | |
|---|---|---|---|---|---|
| 5,435,519 | A | * | 7/1995 | Everingham | 251/129.15 |
| 5,460,146 | A | * | 10/1995 | Frankenberg | 123/568.21 |
| 5,669,364 | A | * | 9/1997 | Everingham | 123/568.21 |
| 5,687,698 | A | * | 11/1997 | Mastro et al. | 123/568.26 |
| 5,779,220 | A | * | 7/1998 | Nehl et al. | 251/129.15 |
| 5,957,117 | A | * | 9/1999 | Everingham | 123/568.26 |
| 6,062,536 | A | * | 5/2000 | Bircann | 251/129.15 |
| 6,247,461 | B1 | * | 6/2001 | Smith et al. | 123/568.21 |

* cited by examiner

*Primary Examiner*—Willis R. Wolfe

(57) ABSTRACT

An automotive emission control valve, an EGR valve in particular, has a solenoid as the actuator for a valve element. The solenoid has a stator and an armature. Various features in construction of the armature and stator pole pieces improve magnetic efficiency to provide increased armature force per unit of solenoid current.

17 Claims, 2 Drawing Sheets

FORCE EMISSION CONTROL VALVE

FIELD OF THE INVENTION

The invention relates generally to electric-actuated automotive emission control valves, such as exhaust gas recirculation (EGR) valves, and in particular to improvements for increasing the operating force of such valves.

BACKGROUND OF THE INVENTION

The actuator of certain emission control valves comprises a solenoid that comprises an electromagnet coil and a stator having an air gap at which magnetic flux acts on an armature. The armature motion is transmitted to a valve element to allow flow through a passageway of the valve. Armature motion is resisted by a return spring that acts on the armature, either directly or via the valve member, to bias the armature to a position that causes the valve element to close the passageway.

The stator air gap is defined by an upper pole piece that is disposed at an upper end of the coil and a lower pole piece at the lower end of the coil. The pole pieces have respective annular hubs that fit into an interior space bounded by the coil, approaching each other from opposite ends of the coil. The juxtaposed ends of the two hubs are spaced apart to define the air gap as an annular space about the armature. Electric current in the coil creates magnetic flux that passes from one hub across the air gap to the armature, through the armature, and back across the air gap to the other hub. The flux causes magnetic force to be applied to the armature, and the axial component of that force acts to displace the armature along the centerline of the solenoid.

In order to operate the valve from closed to open, the solenoid must apply a force that is greater than the bias force being applied by the spring. When a greater spring force is needed for a given valve in a given application, the solenoid must be capable of developing increased force. Because of certain constraints, it may not be possible to simply use a larger, more forceful solenoid. Accordingly, a potentially desirable objective would be to make certain modifications to basic elements of an emission control valve actuator that can increase actuator force without necessarily simply increasing overall size, and inherently weight as well, of the actuator.

SUMMARY OF THE INVENTION

The present invention relates to such modifications.

One general aspect of the invention relates to an emission control valve for controlling flow of gases with respect to combustion chamber space of an internal combustion engine. The valve comprises a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux. An armature is disposed within the interior space for displacement along an imaginary centerline passing through the interior space by the magnetic flux bridging the air gap to position the valve element. A guide extends parallel to the centerline on a first of the pole pieces within the interior space, but stops short of a second of the pole pieces for guiding displacement of the armature along the centerline.

Another aspect relates an emission control valve comprising a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux. An armature is disposed within the interior space for displacement along an imaginary centerline passing through the interior space by the magnetic flux bridging the air gap to position the valve element. The armature comprises holes extending along the centerline from opposite axial ends and ending at a transverse wall. The valve element comprises a valve head that is resiliently biased by a bias spring against a valve seat in closure of the passageway and a stem extending from the valve head into a first of the armature holes. A position sensor for signaling displacement of the armature along the centerline comprises a shaft that extends into a second of the armature holes and is resiliently biased against the transverse wall to in turn bias the transverse wall against the valve stem and define an initial position of the armature when the valve head is against the valve seat. In that initial position, one axial end of the armature is proximate an axial end of the second pole piece at the air gap, and the armature extends completely through the first pole piece to an opposite axial end that protrudes beyond the first pole piece.

Still another aspect relates an emission control valve comprising a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux. An armature is disposed within the interior space for displacement along an imaginary centerline passing through the interior space by the magnetic flux bridging the air gap to position the valve element. The armature comprises a cylindrical outer wall extending between its axial ends and a transverse wall disposed interior of the cylindrical outer wall and spaced axially from both axial ends of the cylindrical outer wall. The transverse wall and the cylindrical outer wall integrally join together at corners that are chamfered as viewed in cross section.

Still another aspect relates an emission control valve comprising a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux. An armature is disposed within the interior space for displacement along an imaginary centerline passing through the interior space by the magnetic flux bridging the air gap to position the valve element. One of the pole pieces comprises a circular cylindrical wall and a flange extending radially outward from an axial end of the circular cylindrical wall that is exterior to the interior space bounded by the coil, and wherein the flange and the circular cylindrical wall integrally join together to form, as viewed in cross section, a square exterior corner of an axial end face of the one pole piece facing away from the interior space bounded by the coil.

Still another aspect relates an emission control valve comprising a valve body comprising a passageway having an inlet port for receiving gases, an outlet port for delivering gases to the combustion chamber space, a valve element that is selectively positioned to selectively restrict the passage, and a mechanism for selectively positioning the valve element. The mechanism comprises a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux. An armature is disposed within the interior space for displacement along an imaginary centerline passing through the interior space by the magnetic flux bridging the air gap to position the valve element. A first of the pole pieces comprises a frustoconical wall that has an increasing radial thickness in a direction away from a second of the pole pieces along the centerline, and a flange extending radially outward from an axial end of the frustoconical wall that is exterior to the interior space bounded by the coil. The flange of the first pole piece and the frustoconical wall integrally join together to form an interior corner that in cross section appears as a chamfer that has a greater taper than the frustoconical wall.

The accompanying drawings, which are incorporated herein and constitute part of this specification, include a presently preferred embodiment of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
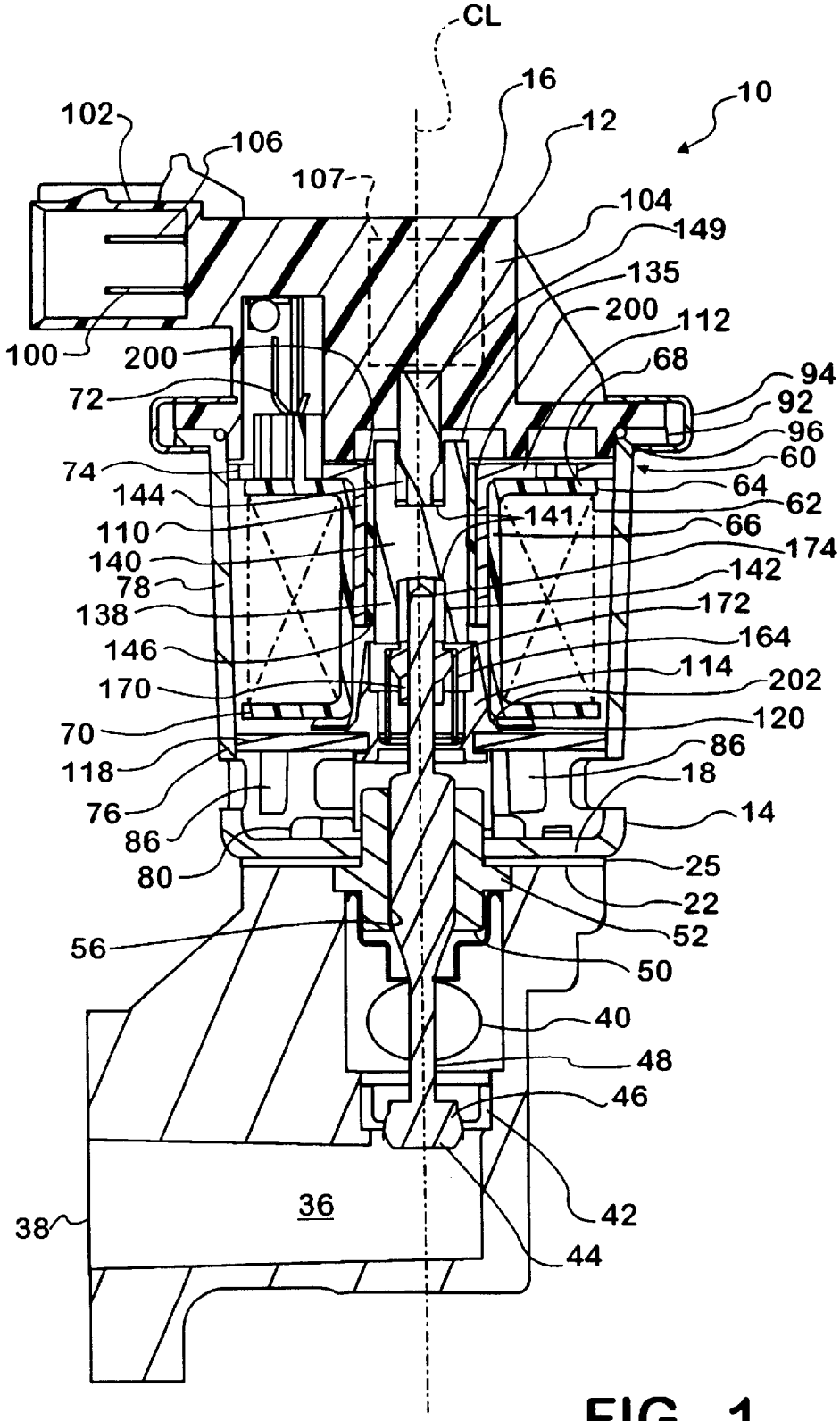
FIG. 1 is a cross section view, in elevation, of an exemplary embodiment of the present invention comprising an emission control valve including a solenoid actuator.

FIG. 1 shows an exemplary EEGR valve 10 that comprises a housing assembly 12 provided by a shell 14 having an open upper end that is closed by a cap 16. Shell 14 further comprises a flat bottom wall 18 that is disposed atop a flat upper surface of a base 22 with a spacer 25 between them. Fasteners secure the shell to the base. Base 22 is adapted to mount on a component of an internal combustion engine, such as a manifold not specifically shown in the drawing.

Valve 10 comprises a flow passage 36 extending through base 22 between an inlet port 38 and an outlet port 40. With valve 10 mounted on the engine, inlet port 38 is placed in communication with engine exhaust gas expelled from the engine cylinders and outlet port 40 is placed in communication with the intake flow into the cylinders.

A valve seat element 42 is disposed in passage 36 proximate inlet port 38 with the outer perimeter of the seat element sealed to the passage wall. Valve seat 42 has an annular shape comprising a through-hole. A one-piece valve member 44 comprises a valve head 46 and a valve stem 48 extending co-axially from head 46 along an imaginary centerline CL of the valve. Head 46 is shaped for cooperation with seat element 42 to close the through-hole in the seat element when valve 10 is in closed position shown in FIG. 1.

Valve 10 further comprises a bearing member 50 that is basically a circular cylindrical member except for a circular flange 52 near its upper end that seats it in a counterbore in base 22.

Bearing member 50 further comprises a central circular through-hole, or through-bore, 56 with which stem 48 has a close sliding fit. Bearing member 50 may comprise a material that possesses some degree of lubricity providing for low-friction guidance of valve member 44 along centerline CL.

Valve 10 further comprises an electromagnetic actuator 60, namely a solenoid, disposed within shell 14 coaxial with centerline CL. Actuator 60 comprises an electromagnetic coil 62 and a polymeric bobbin 64. Bobbin 64 comprises a central tubular core 66 and flanges 68, 70 at opposite ends of core 66. Coil 62 comprises a length of magnet wire wound around core 66 between flanges 68, 70. Respective terminations of the magnet wire are joined to respective electric terminals mounted side-by-side on flange 68, only one terminal 72 appearing in the view of FIG. 1.

Actuator 60 comprises stator structure associated with coil 62 to form a portion of a magnetic circuit path. The stator structure comprises an upper pole piece 74, disposed at one end of the actuator coaxial with centerline CL, and a lower pole piece 76 disposed at the opposite end of the actuator coaxial with centerline CL. Shell 14 comprises a side wall 78, a portion of which extends between pole pieces 74, 76 to complete the stator structure exterior of the coil and bobbin.

An air circulation space 80 is provided within shell 14 axially below actuator 60. The shell side wall has lanced tabs 86 defining a lower ledge on which the outer margin of lower pole piece 76 rests and an upper ledge (not visible in the Fig.) on which the outer margin of upper pole piece 74 rests. Cap 16 comprises an outer margin that is held secure against a rim 92 at the otherwise open end of the shell side wall by a clinch ring 94. A circular seal 96 is disposed between the cap and shell to make a sealed joint between them.

The radial dimension of shell 14 holds upper pole piece 74 in its axially placed position against the tabs 86 forming the upper ledge. Cap 16 comprises a first pair of electric terminals, only one terminal 100 appearing in FIG. 1, that mate respectively with the terminals on bobbin flange 68. The cap terminals protrude externally from the cap material where they are bounded by a surround 102 of the cap material to form a connector adapted for mating connection with a wiring harness connector (not shown) for connecting the actuator to an electric control circuit.

Cap 16 also comprises a tower 104 providing an internal space for a position sensor 107 (shown mainly in phantom) that comprises plural electric terminals, only one terminal 106 appearing in the Figure, that protrude into the surround for connecting the sensor with a circuit via the mating wiring harness connector.

The construction of valve 10 is such that leakage between passage 36 and air circulation space 80 is prevented. Bearing member through-hole 56 is open to passage 36, but valve stem 48 has a sufficiently close sliding fit therein to substantially occlude the through-hole and prevent leakage between passage 36 and air circulation space 80 while providing low-friction guidance of the stem along centerline CL.

Upper pole piece 74 is a ferromagnetic part that comprises a cylindrical-walled, axially-extending annular hub 110 that enters the coil interior space concentric with centerline CL from the upper end of the coil. Hub 110 has a uniform radial thickness with circular inner and outer wall surfaces. Pole piece 74 further comprises an annular radial flange 112 that girdles hub 110 external to the coil interior space in covering relation to a respective end of the coil bobbin. Flange 112 is disposed against bobbin flange 68, thereby axially and radially relating bobbin 64 and upper pole piece 74. Flange 112 has a clearance slot for bobbin terminals 72.

Lower pole piece 76 is an assembly of two ferromagnetic parts, namely a central hub 114 and a circular flange 118 that girdles hub 114. Hub 114 enters the coil interior space from the lower end of the bobbin but stops short of hub 110. An annular wave spring 120 is disposed between flange 118 and bobbin flange 70 for maintaining bobbin flange 68 against flange 112 to compensate for differential thermal expansion.

Hub 114 comprises a radially outer surface that has a frustoconical taper about centerline CL and a radially inner surface that is parallel with centerline CL. Actuator 60 further comprises a one-piece ferromagnetic armature 135 arranged for displacement along centerline CL and cooperating with the stator structure in forming the magnetic circuit of actuator 60.

Armature 135 comprises a circular cylindrical outer wall 138 of uniform radial thickness. Midway between its opposite ends armature 135 has a transverse wall 140. This endows the armature with holes 142, 144 extending along centerline CL from opposite axial ends and ending at transverse wall 140. The length of each hole is approximately one-third the overall length of the armature thereby making the thickness of wall 140, as measured along centerline CL, also approximately one-third of the overall armature length. Walls 138, 140 integrally join together at corners that are chamfered as viewed in cross section, reference numeral 141.

A circular, cylindrical, non-ferromagnetic sleeve 146 is fit to the inner circular cylindrical surface of hub 110. Sleeve 146 has a length, as measured along centerline CL that is substantially equal to the overall length of upper pole piece 74 so that neither end protrudes in any substantial amount from that pole piece. The inner circular surface of sleeve 146 has a diameter just slightly greater than the outside diameter of armature wall 138 to provide close-running guidance of displacement of armature 135 along centerline CL.

Armature 135, upper pole piece 74, lower pole piece 76, and electromagnet coil 62 are arranged in an assembled relationship to dispose a majority of armature 135 within the interior space bounded by coil 62 and with the pole pieces disposed at opposite ends of the coil to create the air gap within the coil interior space and to associate the pole pieces with the portion of shell side wall 78 that conducts magnetic flux between the pole pieces external to the coil interior space.

FIG. 1 shows the closed position of valve 10 wherein a preloaded helical coil spring 164 is resiliently biasing valve head 46 to seat on seat element 42, closing passage 36 to flow between ports 38 and 40. A spring seat element 170 is crimped onto the free end of valve stem 48 and comprises both a seat 172 for one end of spring 164 and a post 174 that in effect forms an extension of the valve stem. Post 174 enters armature hole 142, with radial clearance, to abut the lower face of transverse wall 140. Position sensor 107 comprises has a shaft 149 that extends from the sensor body along centerline CL and enters hole 144, also with radial clearance. An internal spring in the position sensor resiliently biases the end of shaft 149 against the upper face of transverse wall 140. The opposite end of spring 164 seats on wall 18.

Spring 164 forms an element of the internal valve mechanism, functioning to resiliently bias armature 135 to an initial position along centerline CL when no current flows in coil 62. In that initial position one axial end of armature 135 is proximate the narrow axial end of lower pole piece 76 at the air gap, and armature 135 extends completely through the upper pole piece 74 to protrude beyond the latter pole piece.

The resilient bias that position sensor 107 imparts to armature 135 via shaft 149 in turn biases transverse wall 140 against the valve stem, as extended by post 174 of element 170, defines an initial position of the armature when valve head 46 is against valve seat 42.

As electric current begins to increasingly flow through coil 62, the magnetic circuit exerts increasing force urging armature 135 in the downward direction as viewed in FIG. 1. Once the force is large enough to overcome the bias of the pre-load force of spring 164, armature 135 begins to move downward, similarly moving valve element 44 and opening valve 10 to allow flow through passage 36 between the two ports. The extent to which the valve is allowed to open is controlled by the electric current in coil 62. Because armature 135 is captured axially between the spring-biased shaft 149 and post 174 as the armature is displaced, shaft 149 tracks the extent of armature displacement to enable position sensor 107 to provide a feedback signal representing valve position, and hence the extent of valve opening. The actual control strategy for the valve is determined as part of the overall engine control strategy embodied by an associated electronic engine control.

The nature of the interface between post 174 and armature 135 compensates for any slight non-concentricity between bearing member 50 and armature 135 such that force transmitted between them is essentially exclusively substantially along centerline CL rather than having a radial component that might undesirably affect the transmission of motion from one to the other. The armature also transmits motion to position sensor 107 via a similar interface with shaft 149.

Because sleeve 146 is fit to only pole piece 74, and not pole piece 76, it becomes possible to reduce the radial clearance between the radially inner surface of pole piece wall 114 and the outer surface of armature side wall 138. Such reduction in radial clearance that makes the diameter of the radially inner surface of wall 114 less than that of upper pole piece wall 110 is useful in increasing the efficiency of the magnetic circuit by increasing the electromagnetic force that can be developed for a given amount of coil current.

Particular features of the two pole pieces can provide additional improvement in magnetic circuit efficiency. In upper pole piece 74, flange 112 extends radially outward from the axial end of hub 110 that is exterior to the interior space bounded by the coil. Where flange 112 and the circular cylindrical wall formed by hub 110 integrally join together, they form, as viewed in cross section, a square exterior corner 200 of an axial end face of the pole piece that faces away from the interior space bounded by coil 62. The interior corner is shown to be radiused.

In lower pole piece 76, the frustoconical wall formed by hub 114 has an increasing radial thickness in a direction away from pole piece 76 along centerline CL. Flange 118 extends radially outward from the axial end of hub 114 that is exterior to the interior space bounded by the coil, and where flange 118 and hub 114 join together, the interior corner is shown in cross section to have a chamfer 202 that has a greater taper than the frustoconical wall. The chamfer is provided as a surface in a shoulder of hub 114 opposite a surface of the shoulder against which flange 118 is disposed.

The arrangement of the armature, as described above, is considered beneficial in improving magnetic efficiency, particularly with its increased length and transverse wall thickness. The chamfered corners that join the two walls 138, 140 of armature 135, and the increased thickness of the pole piece flanges and the closer coupling of the coil to the upper pole piece are also considered beneficial.

Figure 2:
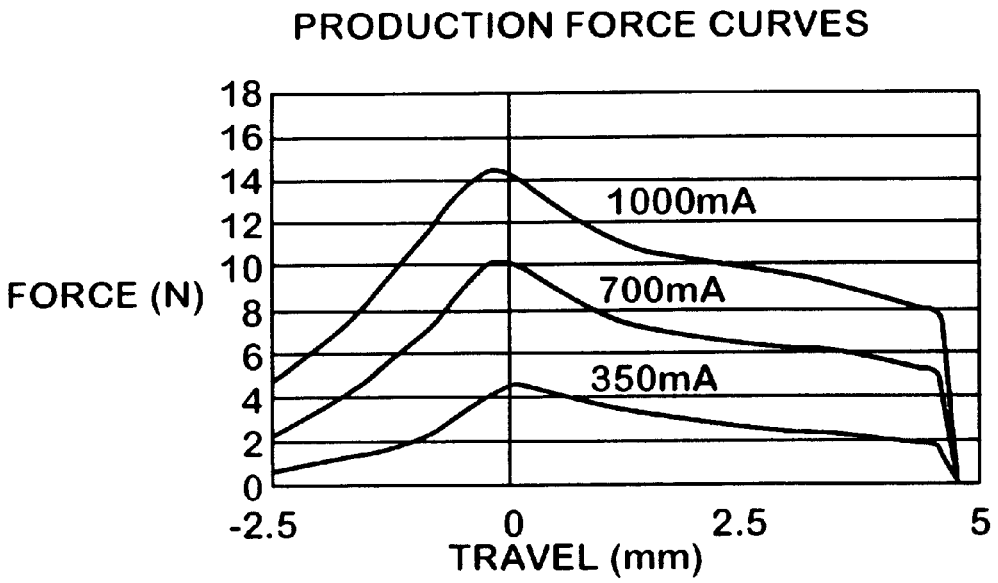
FIGS. 2 and 3 are comparison graph plots for showing representative force improvement that can be achieved with the present invention.
Figure 3:
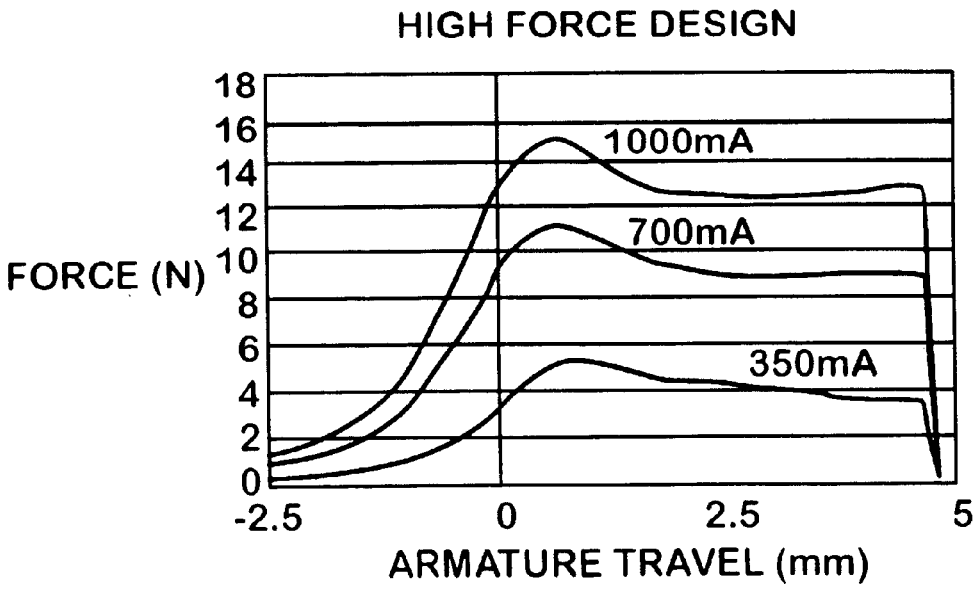

FIG. 2 is a graph plot showing armature force as a function of armature displacement for several different values of coil current in a known valve that does not embody the novel features of valve 10. FIG. 3 is a graph plot showing armature force as a function of armature displacement for values of coil current corresponding to those in FIG. 2, but for a valve 10 that does embody the novel features described herein. The force per unit of current is significantly increased for virtually all displacements up to near maximum displacement. It is believed that this improvement results in large measure from the closer coupling of the armature to the stator and because saturation is avoided in certain portions of the magnetic circuit. The chamfers are believed to have a significant effect in avoiding magnetic saturation.

While the foregoing has described a preferred embodiment of the present invention, it is to be appreciated that the inventive principles may be practiced in any form that falls within the scope of the following claims.

What is claimed is:

1. An emission control valve for controlling flow of gases with respect to combustion chamber space of an internal combustion engine comprising:

a valve body comprising a passageway having an inlet port for receiving gases and an outlet port for delivering gases to the combustion chamber space;

a valve element that is selectively positioned to selectively restrict the passage; and a mechanism for selectively positioning the valve element comprising a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux, and an armature that is disposed within the interior space to be displaced along an imaginary centerline passing through the interior space by the magnetic flux bridging the air gap to position the valve element;

wherein the armature comprises a cylindrical outer wail extending between its axial ends and a transverse wall disposed interior of the cylindrical outer wall and spaced axially from both axial ends of the cylindrical outer wall, and the transverse wall and the cylindrical outer wall integrally join together at corners that are chamfered as viewed in cross section.

2. An emission control valve for controlling flow of gases with respect to combustion chamber space of an internal combustion engine comprising:

a valve body comprising a passageway having an inlet port for receiving gases and an outlet port for delivering gases to the combustion chamber space;

a valve element that is selectively positioned to selectively restrict the passage; and a mechanism for selectively positioning the valve element comprising a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux, and an armature that is disposed within the interior space to be displaced along an imaginary centerline passing through the interior space by the magnetic flux bridging the air gap to position the valve element;

wherein one of the pole pieces comprises a circular cylindrical wall and a flange extending radially outward from an axial end of the circular cylindrical wail that is exterior to the interior space bounded by the coil, and wherein the flange and the circular cylindrical wall integrally join together to form, as viewed in cross section, a square exterior corner of an axial end face of the one pole piece facing away from the interior space bounded by the coil; and wherein another of the pole pieces comprises a frustoconical wall that has an increasing radial thickness in a direction away from the one pole piece along the centerline provided by a tapered radially outer wall surface, and a flange extending radially outward from an axial end of the frustoconical wall that is exterior to the interior space bounded by the coil, and wherein the flange of the second pole piece and the frustoconical wall integrally join together to form an interior corner that in cross section appears as a chamfer that continues from the tapered radially outer wall surface of the frustoconical wall and has a greater taper than that of the radially outer wall surface of the frustoconical wall.

3. An emission control valve for controlling flow of gases with respect to combustion chamber space of an internal combustion engine comprising:

a valve body comprising a passageway having an inlet port for receiving gases and an outlet port for delivering gases to the combustion chamber space;

a valve element that is selectively positioned to selectively restrict the passage;

a mechanism for selectively positioning the valve element comprising a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux, and an armature that is disposed within the interior space to be displaced along an imaginary centerline passing through the interior space by the magnetic flux bridging the air gap to position the valve element;

wherein a first of the pole pieces comprises a frustoconical wall that has an increasing radial thickness in a direction away from a second of the pole pieces along the centerline provided by a tapered radially outer wall surface, and a flange extending radially outward from an axial end of the frustoconical wall that is exterior to the interior space bounded by the coil, and wherein the flange of the first pole piece and the frustoconical wall join together to form an interior corner that in cross section appears as a chamfer that continues from the tapered radially outer wall surface of the frustoconical wall and has a greater taper than that of the radially outer wall surface of the frustoconical wall.

4. An emission control valve for controlling flow of gases with respect to combustion chamber space of an internal combustion engine comprising:

a valve body comprising a passageway having an inlet port for receiving gases and an outlet port for delivering gases to the combustion chamber space;

a valve element that is selectively positioned to selectively restrict the passage; and a mechanism for selectively positioning the valve element comprising a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux, and an armature that is disposed within the interior space to be displaced along an imaginary centerline passing through the interior space by the magnetic flux bridging the air gap to position the valve element; and a guide extending parallel to the centerline on a first of the pole pieces within the interior space, but stopping short of a second of the pole pieces for guiding displacement of the armature along the centerline.

5. An emission control valve as set forth in claim 4 wherein the first pole piece comprises a circular cylindrical wall within which the guide is disposed and a flange extending radially outward front an axial end of the circular cylindrical wall that is exterior to the interior space bounded by the coil, and wherein the flange and the circular cylindrical wall integrally join together to form, as viewed in crass section, a square exterior corner of an axial end face of the first pole piece facing away from the interior space bounded by the coil.

6. An emission control valve as set forth in claim 5 wherein the second pole piece comprises a frustoconical wall that has an increasing radial thickness in a direction away from the first pole piece along the centerline, and a flange extending radially outward from an axial end of the frustoconical wall that is exterior to the interior space bounded by the coil, and wherein the flange of the second pole piece and the frustoconical wall integrally join together to form an interior corner that in cross section appears as a chamfer that has a greater taper than the frustoconical wall.

7. An emission control valve as set forth in claim 4 wherein the first pole piece has a circular inside diameter within which the guide is disposed, the guide comprises a non-ferromagnetic sleeve having a circular inside diameter guiding the armature, the armature has a circular outside diameter confronting the circular inside diameter of the sleeve and a circular inside diameter of the second pole piece, and the circular inside diameter of the second pole piece is less that the circular inside diameter of the first pole piece.

8. An emission control valve as set forth in claim 7 wherein the outside diameter of the second pole piece is frustoconical and imparts an increasing radial thickness to the second pole piece in a direction away from the first pole piece along the centerline.

9. An emission control valve as set forth in claim 8 wherein the mechanism comprises a spring for resiliently biasing the armature to an initial position along the centerline when no current flows in the coil, and in that initial position one axial end of the armature is proximate an axial end of the second pole piece at the air gap, and the armature extends completely through the first pole piece to an opposite axial end that protrudes beyond the first pole piece.

10. An emission control valve as set forth in claim 9 wherein the armature comprises a cylindrical outer wall extending between its axial ends and a transverse wall disposed interior of the cylindrical outer wall and spaced axially from both axial ends of the cylindrical outer wall.

11. An emission control valve as set forth in claim 10 wherein the transverse wall has a thickness that is approximately one-third the length of the armature, as both thickness and length are measured along the centerline, and the transverse wall is disposed substantially equidistant from opposite axial ends of the cylindrical outer wall.

12. An emission control valve as set forth in claim 11 wherein the transverse wall and the cylindrical outer wall integrally join together at corners that are chamfered as viewed in cross section.

13. An emission control valve for controlling flow of gases with respect to combustion chamber space of an internal combustion engine comprising:

a valve body comprising a passageway having an inlet port for receiving gases and an outlet port for delivering gases to the combustion chamber space;

a valve element that is selectively positioned to selectively restrict the passage; and a mechanism for selectively positioning the valve element comprising a solenoid having an electromagnet coil bounding an interior space, a stator that is associated with the coil to provide a magnetic circuit for conducting magnetic flux generated electric current flows in the coil and that comprises pole pieces cooperatively defining an air gap disposed within the interior space bounded by the coil and bridged by the magnetic flux, and an armature that is disposed within the interior space to be displaced along an imaginary centerline passing through the interior space by the magnetic flux bridging the air gap to position the valve element, the armature comprising holes extending along the centerline from opposite axial ends and ending at a transverse wall;

wherein the valve element comprises a valve head that is resiliently biased by a bias spring against a valve seat in closure of the passageway and a stern extending from the valve head into a first of the armature holes;

including a position sensor for signaling displacement of the armature along the centerline arid comprising a shaft that extends into a second of the armature holes and is resiliently biased against the transverse wall to in turn bias the transverse wall against the valve stem and define an initial position of the armature when the valve head is against the valve scat, and in that initial position, one axial end of the armature is proximate an axial end of the second pole piece at the air gap, and the armature extends completely through the first pole piece to an opposite axial end that protrudes beyond the first pole piece.

14. An emission control valve as set forth in claim 13 wherein the transverse wall has a thickness that is approximately one-third the overall length of the armature, as both thickness and overall length are measured along the centerline, and the transverse wall is disposed substantially equidistant from opposite axial ends of the armature.

15. An emission control valve as set forth in claim 14 wherein armature comprises a cylindrical outer wall circumferentially surrounding the armature holes, and the transverse wall and the cylindrical outer wall integrally join together at corners that are chamfered as viewed in cross section.

16. An emission control valve as set forth in claim 15 wherein the first pole piece comprises a circular cylindrical wall extending within the interior space bounded by the coil and a flange extending radially outward from an axial end of the circular cylindrical wall that is exterior to the interior space bounded by the coil, and wherein the flange and the circular cylindrical wall integrally join together to form, as viewed in cross section, a square exterior corner of an axial end face of the first pole piece facing away from the interior space bounded by the coil.

17. An emission control valve as set forth in claim 16 wherein the second pole piece comprises a frustoconical wall that has an increasing radial thickness in a direction away from the first pole piece along the centerline, and a flange extending radially outward from an axial end of the frustoconical wall that is exterior to the interior space bounded by the coil, and wherein the flange of the second pole piece and the frustoconical wall integrally join together to form an interior corner that in cross section appears as a chamfer that has a greater taper than the frustoconical wall.

* * * * *